US005622925A

United States Patent [19]

de Buzzaccarini et al.

[11] Patent Number: 5,622,925

[45] Date of Patent: *Apr. 22, 1997

[54] STABLE, AQUEOUS LAUNDRY DETERGENT COMPOSITION HAVING IMPROVED SOFTENING PROPERTIES

[75] Inventors: Francesco de Buzzaccarini, Fairfield; Timothy J. Farwick, Cincinnati; Yueqian Zhen, West Chester, all of Ohio

[73] Assignee: The Procter & Gamble Company, Cincinnati, Ohio

[ * ] Notice: The term of this patent shall not extend beyond the expiration date of Pat. No. 5,466,394.

[21] Appl. No.: 541,204

[22] Filed: Nov. 8, 1995

Related U.S. Application Data

[63] Continuation of Ser. No. 232,509, Apr. 25, 1994, abandoned.

[51] Int. Cl.[6] ..... C11D 1/04; C11D 1/29; C11D 1/62; C11D 1/65

[52] U.S. Cl. ..... 510/329; 510/327; 510/504; 510/495; 510/491; 510/322

[58] Field of Search ..... 252/551, 547, 252/174.21, 174.12, 117, 121, DIG. 13; 510/329, 327, 504, 495, 491, 322

[56] References Cited

U.S. PATENT DOCUMENTS

| | | | |
|---|---|---|---|
| 3,607,763 | 9/1971 | Salmen et al. | 252/137 |
| 3,644,203 | 2/1972 | Lamberti et al. | 510/331 |
| 3,689,424 | 9/1972 | Berg et al. | 252/110 |
| 3,886,075 | 5/1975 | Bernardino | 252/8.75 |
| 3,936,537 | 2/1976 | Baskerville, Jr. et al. | 427/242 |
| 3,954,632 | 5/1976 | Gloss | 252/8.8 |
| 4,212,749 | 7/1980 | Kolbe | 252/8.75 |
| 4,239,659 | 12/1980 | Murphy | 252/524 |
| 4,255,294 | 3/1981 | Rudy et al. | 252/524 |
| 4,260,529 | 4/1981 | Letton | 252/547 |
| 4,285,841 | 8/1981 | Barrat et al. | 252/559 |
| 4,292,035 | 9/1981 | Battrell | 252/8.6 |
| 4,298,480 | 11/1981 | Wixon | 252/8.75 |
| 4,302,364 | 11/1981 | Gosset et al. | 252/545 |
| 4,308,024 | 12/1981 | Wells | 8/137 |
| 4,321,165 | 3/1982 | Smith et al. | 252/528 |
| 4,329,237 | 5/1982 | Wixon | 252/8.75 |
| 4,333,862 | 6/1982 | Smith et al. | 252/547 |
| 4,338,204 | 7/1982 | Spadini et al. | 252/8.75 |
| 4,464,272 | 8/1984 | Parslow et al. | 252/8.8 |
| 4,479,881 | 10/1984 | Tai | 252/8.8 |
| 4,561,998 | 12/1985 | Wertz | 252/547 |
| 4,661,289 | 4/1987 | Parslow et al. | 252/547 |
| 4,701,322 | 10/1987 | Dixon et al. | 424/70 |
| 4,751,009 | 6/1988 | Damaso et al. | 252/8.75 |
| 5,104,645 | 4/1992 | Cardin et al. | 424/70 |
| 5,174,927 | 12/1992 | Honsa | 252/543 |
| 5,288,417 | 2/1994 | Bauer et al. | 252/8.8 |
| 5,466,394 | 11/1995 | de Buzzaccarini et al. | 252/547 |

FOREIGN PATENT DOCUMENTS

| | | | |
|---|---|---|---|
| 0026529A1 | 4/1981 | European Pat. Off. | C11D 1/62 |
| 0095205A1 | 11/1983 | European Pat. Off. | C11D 1/65 |
| 0151678A1 | 8/1985 | European Pat. Off. | C11D 17/00 |
| 2236925 | 3/1975 | France . | |
| 62-260900 | 11/1987 | Japan . | |
| 1079388 | 8/1967 | United Kingdom . | |
| 2177108 | 1/1987 | United Kingdom . | |
| 2178443 | 2/1987 | United Kingdom . | |
| 2204609 | 11/1988 | United Kingdom | D06M 13/46 |
| WO80/11522 | 11/1989 | WIPO | C11D 1/62 |

*Primary Examiner*—Douglas J. McGinty
*Assistant Examiner*—Michael P. Tierney
*Attorney, Agent, or Firm*—Michael D. Jones; George W. Allen; Jerry J. Yetter

[57] ABSTRACT

Heavy duty liquid detergent compositions containing an anionic surfactant component, fatty acid and a quaternary ammonium fabric-softening agent of the formula

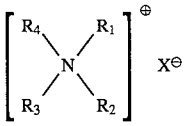

The anionic surfactant component comprises, by weight of the composition, from about 5% to 40% of alkyl polyethoxylate sulfates and no more than about 5% of alkyl benzene sulfonates. The compositions are substantially clear and isotropic, provide excellent cleaning of soils and provide softening through the wash and anti-static benefits. The compositions preferably also contain an ethoxylated nonionic surfactant, a detergent builder and enzymes.

30 Claims, No Drawings

STABLE, AQUEOUS LAUNDRY DETERGENT COMPOSITION HAVING IMPROVED SOFTENING PROPERTIES

This is a continuation of application Ser. No. 08/232,509, filed on Apr. 25, 1994.

TECHNICAL FIELD

The present invention relates to stable, aqueous heavy duty liquid laundry detergent compositions which provide exceptional cleaning as well as fabric softening and anti-static benefits. The detergent compositions herein are substantially clear and isotropic and comprise an anionic surfactant component, a quaternary ammonium fabric-softening agent and a fatty acid. The anionic surfactant component comprises alkyl polyethoxylate sulfates and a limited amount of alkyl benzene sulfonates.

BACKGROUND OF THE INVENTION

Numerous attempts have been made to formulate laundry detergent compositions that have good cleaning properties together with textile softening properties so as to avoid the necessity of using a separate rinse-added textile softener product in addition to the usual laundry detergent. Since cleaning by definition involves the removal of material from the textile surface and textile softening normally involves deposition of material onto the same surface, these attempts have typically required a compromise in formulation between cleaning and softening performance.

Cationic surfactants, including quaternary ammonium surfactants, have long been known as useful additives in laundry detergent compositions for the purpose of providing laundered fabrics with a static control benefit (see e.g. U.S. Pat. No. 3,951,879, Wixon, issued Apr. 20, 1976, and U.S. Pat. No. 3,959,157, Inamorato, issued May 25, 1976, both of which are incorporated herein by reference), a fabric softening benefit (see e.g., U.S. Pat. No. 3,607,763, Salmen et al, issued Sep. 21, 1971, U.S. Pat. No. 3,644,203, Lamberti et al, issued Feb. 22, 1972, and U.S. Pat. No. 3,537,993, Coward et al, issued Nov. 3, 1970, all of which are incorporated herein by reference), or a sanitization benefit (see e.g., U.S. Pat. No. 2,742,434, Kopp, issued Apr. 17, 956, U.S. Pat. No. 3,539,520, Cantor et al, issued Nov. 10, 1970, and U.S. Pat. No. 3,965,026, Lancz, issued Jun. 22, 1976, all of which are incorporated herein by reference).

Attempts to formulate aqueous heavy duty liquid laundry detergent compositions containing anionic surfactants and a quaternary ammonium fabric-softening agent like lauryl trimethyl ammonium chloride and which provide softening through the wash and static control benefits have resulted in poor physical product characteristics including phase split or have resulted in poor fabric cleaning performance.

It has now been found that aqueous, heavy duty liquid detergent compositions containing certain anionic surfactants, a quaternary ammonium fabric-softening agent and a fatty acid provide softening through the wash and antistatic benefits, excellent cleaning performance, and attractive product characteristics, i.e., are substantially clear, isotropic and phase stable. It has been found that by limiting the level of alkyl benzene sulfonates in aqueous, detergent compositions containing alkyl polyethoxylate sulfates, unsightly precipitates are prevented or inhibited from forming in the detergent product and superior performance (vis-à-vis cleaning, softening through the wash and antistatic benefits) is promoted. The fatty acid component provides additional fabric-softening benefits to the detergent compositions herein and enhanced cleaning of fabrics.

Therefore, it is an object of the invention herein to provide a substantially clear, isotropic aqueous heavy duty liquid laundry detergent composition which provides excellent cleaning and softening through the wash and anti-static benefits.

SUMMARY OF THE INVENTION

The present invention encompasses substantially clear, aqueous, isotropic heavy duty liquid laundry detergent compositions comprising, by weight of the composition:

a) from about 10% to about 40% of an anionic surfactant component which comprises, by weight of the composition:
   (i) from about 5% to 40% of alkyl polyethoxylate sulfates wherein the alkyl group contains from 10 to 22 carbon atoms and the polyethoxylate chain contains from 1 to 15 ethylene oxide moieties; and
   (ii) no more than about 5% of alkyl benzene sulfonates;

b) from about 1% to about 10% of a quaternary ammonium fabric-softening agent having the formula

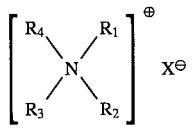

wherein $R_1$ and $R_2$ are individually selected from the group consisting of $C_1$–$C_4$ alkyl, $C_1$–$C_4$ hydroxy alkyl, benzyl, and —$(C_2H_4O)_xH$ where x has a value from 2 to 5; X is an anion; and (1) $R_3$ and $R_4$ are each a $C_8$–$C_{14}$ alkyl or (2) $R_3$ is a $C_8$–$C_{22}$ alkyl and $R_4$ is selected from the group consisting of $C_1$–$C_{10}$ alkyl, $C_1$–$C_{10}$ hydroxy alkyl, benzyl, and —$(C_2H_4O)_xH$ where x has a value from 2 to 5; and c) from about 1% to about 10% of a fatty acid containing from about 8 to about 20 carbon atoms.

Preferred compositions herein comprise the quaternary ammonium softening agent and the fatty acid in a weight ratio of about 1:3 to about 3:1.

DETAILED DESCRIPTION OF THE INVENTION

In accordance with the present invention, it has now been found that a stable, aqueous heavy duty liquid detergent composition is surprisingly formed when certain anionic surfactants, a quaternary ammonium softening agent and a fatty acid are combined in relative proportions specified hereinafter. The composition is substantially clear and isotropic and provide notable cleaning and softening through the wash benefits. As used herein, the term "isotropic" indicates a single continuous phase, e.g., a liquid. A slurry or liquid having suspended crystals, precipitates or more than one liquid or liquid crystalline phase would not fall within the scope thereof. As used herein, the term "substantially clear" means aesthetically clear, transparent or translucent.

The heavy duty liquid laundry detergent compositions herein contain an anionic surfactant component, a quaternary ammonium fabric-softening agent and a fatty acid as essential ingredients.

Anionic Surfactant Component

The detergent compositions herein comprise from about 10% to about 40% preferably from about 15% to about 25%, by weight of the detergent composition, of an anionic surfactant component. The anionic surfactant component contains alkyl polyethoxylate sulfates, and may contain other non-soap anionic surfactants, or mixtures thereof. The anionic surfactant component must not contain more than about 5% of alkyl benzene sulfonates.

Generally speaking, anionic surfactants useful herein are disclosed in U.S. Pat. No. 4,285,841, Barrat et al, issued Aug. 25, 1981, and in U.S. Pat. No. 3,919,678, Laughlin et al, issued Dec. 30, 1975, both incorporated herein by reference.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil.

Other anionic surfactants herein are the water-soluble salts of: paraffin sulfonates containing from about 8 to about 24 (preferably about 12 to 18) carbon atoms; alkyl glyceryl ether sulfonates, especially those ethers of $C_{8-18}$ alcohols (e.g., those derived from tallow and coconut oil); alkyl phenol ethylene oxide ether sulfates containing from about 1 to about 4 units of ethylene oxide per molecule and from about 8 to about 12 carbon atoms in the alkyl group; and alkyl ethylene oxide ether sulfates containing about 1 to about 4 units of ethylene oxide per molecule and from about 10 to about 20 carbon atoms in the alkyl group.

Other useful anionic surfactants herein include the water-soluble salts of esters of α-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety.

Particularly preferred anionic surfactants herein are the alkyl polyethoxylate sulfates of the formula $$RO(C_2H_4O)_xSO_3^-M^+$$

wherein R is an alkyl chain having from about 10 to about 22 carbon atoms, saturated or unsaturated, and the longest linear portion of the alkyl chain is 15 carbon atoms or less on the average, M is a cation which makes the compound water-soluble, especially an alkali metal, ammonium or substituted ammonium cation, and x is from 1 to about 15. The anionic surfactant component of the present compositions comprises from about 5% to about 40%, preferably from about 7% to about 36%, most preferably from about 10% to about 25%, by weight of the detergent composition, of alkyl polyethoxylate sulfates as described above.

Other preferred anionic surfactants are the non-ethoxylated $C_{12-15}$ primary and secondary alkyl sulfates. Under cold water washing conditions, i.e., less than abut 65° F. (18.3° C.), it is preferred that there be a mixture of such ethoxylated and non-ethoxylated alkyl sulfates.

Mixtures of the alkyl sulfates with the above-described paraffin sulfonates, alkyl glyceryl ether sulfonates and esters of a α-sulfonated fatty acids, are also preferred.

The anionic surfactant component herein must comprise no more than about 5%, preferably less than about 3%, more preferably less than about 1% of alkyl benzene sulfonates. Most preferably, the detergent compositions herein contain no alkyl benzene sulfonates. These include alkylbenzene sulfonates in which the alkyl group contains from about 9 to about 15 carbon atoms, in straight chain or branched chain configuration, e.g., those of the type described in U.S. Pat. No. 2,220,099 and No. 2,477,383. Especially troublesome are linear straight chain alkylbenzene sulfonates in which the average number of carbon atoms in the alkyl group is from about 11 to 14.

While not intending to be limited by theory, it is believed that the quaternary ammonium agent (a cationic surfactant) and anionic surfactants typically form ion pair complexes in aqueous solutions. The ion pairs formed between the described cationic surfactants and alkylbenzene sulfonate salts have low solubility and precipitate as a separate solid salt. This not only has a negative effect on their cleaning performance, but also prevents their use in isotropic liquid detergents. On the other hand, ion pairs formed by the described cationic surfactants and alkyl polyethoxylate sulfates are much more soluble in the liquid detergent composition herein. This allows for the formulation of isotropic liquid detergents where the cationic agent provides softening, antistatic and cleaning performance, and the cleaning performance of the alkyl polyethoxylate is not impaired.

Quaternary Ammonium Fabric-Softening Agent

The compositions herein also contain from about 1% to about 10%, preferably from about 2% to about 7%, more preferably from about 3% to about 5% by weight of a quaternary ammonium fabric-softening agent of the formula:

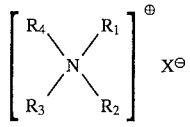

wherein $R_1$ and $R_2$ are individually selected from the group consisting of $C_1$–$C_4$ alkyl, $C_1$–$C_4$ hydroxy alkyl, benzyl, and —$(C_2H_4O)_xH$ where x has a value from 2 to 5; X is an anion; and (1) $R_3$ and $R_4$ are each a $C_8$–$C_{14}$ alkyl or (2) $R_4$ is a $C_8$–$C_{22}$ alkyl and $R_3$ is selected from the group consisting of $C_1$–$C_{10}$ alkyl, $C_1$–$C_{10}$ hydroxy alkyl, benzyl, and —$(C_2H_4O)_xH$ where x has a value from 2 to 5.

Preferred of the above are the mono-long chain alkyl quaternary ammonium surfactants wherein the above formula $R_1$, $R_2$, and $R_3$ are each methyl and $R_4$ is a $C_8$–$C_{18}$ alkyl.

The most preferred quaternary ammonium surfactants are the chloride, bromide and methylsulfate $C_{8-16}$ alkyl trimethyl ammonium salts, and $C_{8-16}$ alkyl di(hydroxyethyl)-methyl ammonium salts. Of the above, lauryl trimethyl ammonium chloride, myristyl trimethyl ammonium chloride and coconut trimethylammonium chloride and methylsulfate are particularly preferred. ADOGEN 412™, a lauryl trimethyl ammonium chloride commercially available from Witco, is a preferred softening agent herein.

Another class of preferred quaternary ammonium surfactants are the di-$C_8$–$C_{14}$ alkyl dimethyl ammonium chloride or methylsulfates; particularly preferred is di- $C_{12}$–$C_{14}$ alkyl dimethyl ammonium chloride. This class of materials is particularly suited to providing antistatic benefits to fabrics. Materials having two alkyl chainlengths longer than $C_{14}$, like di- $C_{16}$–$C_{18}$ alkyl dimethyl ammonium chloride, which are commonly used in rinse added fabric softeners, are not included in this invention, since they do not yield isotropic liquid detergents when combined with the anionic surfactants described above.

A preferred embodiment of the invention herein comprises the detergent composition wherein the weight ratio of anionic surfactant component to quaternary ammonium softening agent of from about 3:1 to about 20:1.

Fatty Acid

The compositions of the present invention contain from about 1% to about 10%, preferably from about 2% to about 7%, most preferably from about 3% to about 5%, by weight of a fatty acid containing from about 8 to about 20 carbon atoms. The fatty acid can also contain from about 1 to about 10 ethylene oxide units in the hydrocarbon chain.

Suitable fatty acids are saturated and/or unsaturated and can be obtained from natural sources such a plant or animal esters (e.g., palm kernel oil, palm oil, coconut oil, babassu oil, safflower oil, tall oil, castor oil, tallow and fish oils, grease, and mixtures thereof), or synthetically prepared (e.g., via the oxidation of petroleum or by hydrogenation of carbon monoxide via the Fisher Tropsch process). Examples of suitable saturated fatty acids for use in the compositions of this invention include capric, laurie, myristic, palmitic, stearic, arachidic and behenic acid. Suitable unsaturated fatty acid species include: palmitoleic, oleic, linoleic, linolenic and ricinoleic acid. Examples of preferred fatty acids are saturated $C_{12}$ fatty acid, saturated $C_{12}$–$C_{14}$ fatty acids, and saturated or unsaturated $C_{12}$ to $C_{18}$ fatty acids, and mixtures thereof.

In the detergent compositions herein, the weight ratio of quaternary ammonium softening agent to fatty acid is preferably from about 1:3 to about 3:1, more preferably from about 1:1.5 to about 1.5:1, most preferably about 1:1.

Optional Components

The compositions of the present invention can also preferably contain up to about 30%, preferably from about 1% to about 20%, more preferably from about 2% to about 10%, by weight of an ethoxylated nonionic surfactant. These materials are described in U.S. Pat. No. 4,285,841, Barrat et al, issued Aug. 25, 1981, incorporated herein by reference. Preferred are the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. These surfactants are more fully described in U.S. Pat. No. 4,284,532, Leikhim et al, issued Aug. 18, 1981, incorporated herein by reference. Particularly preferred are ethoxylated alcohols having an average of from about 10 to abut 15 carbon atoms in the alcohol and an average degree of ethoxylation of from about 6 to about 12 moles of ethylene oxide per mole of alcohol.

The addition of the ethoxylated nonionic surfactant to compositions of the invention herein is helpful in providing physical stability to the detergent product, i.e., preventing phase splits and precipitation. This is particularly true for compositions containing high levels of quaternary ammonium agent and/or low levels of anionic surfactant. Therefore, a preferred embodiment of the invention herein comprises at least about 2% of the nonionic surfactant in the detergent compositions herein.

The compositions herein also preferably contain up to about 30%, more preferably from about 1% to about 20%, most preferably from about 1% to about 10%, by weight of a detergent builder material. While all manner of detergent builders known in the art can be used in the present compositions, the type and level of builder should be selected such that the final composition has an initial pH of from about 7.0 to about 9.0 at a concentration of from about 1% to about 10% by weight in water at 20° C. Detergent builders are described in U.S. Pat. No. 4,321,165, Smith et al, issued Mar. 23, 1982, incorporated herein by reference. In the preferred liquid detergent compositions herein, the builder preferably represents from about 1% to about 20%, more preferably from abut 3% to about 10%, by weight of the composition. Preferred builders for use in liquid detergents herein are described in U.S. Pat. No. 4,284,532, Leikhim et al, issued Aug. 18, 1981, incorporated herein by reference. A particularly preferred builder is citric acid.

Enzymes can be included in tile formulations herein for a wide variety of fabric laundering purposes, including removal of protein-based, carbohydrate-based, or triglyceride-based stains, for example, and for fabric restoration. The enzymes to be incorporated include proteases, amylases, lipases, and cellulases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases. Particularly preferred compositions herein contain from about 0.05% to about 2% by weight of detersive enzymes, especially tile amylases, proteases, and mixtures thereof, of the type well known to detergent formulators.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of B. subtilis and B. licheniforms. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Pat. Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Ser. No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS.247.832CAREZYME (Novo) is especially useful.

Suitable lipase enzymes for detergent usage include those produced by microorganisms of the Pseudomonas group, such as Pseudomonas stutzeri ATCC 19.154, as disclosed in British Patent. 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano", hereinafter referred to as "Amano-P". Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Diosynth Co., The Netherlands, and lipases ex Pseudomonas gladioli. The LIPOLASE enzyme derived from Humicola lanuginosa and commercially available from Novo (see also EPO 341,947) is a preferred lipase for use herein.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

The enzymes employed herein may be stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species. See Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 4%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

Other preferred components for use in liquid detergents herein are the neutralizing agents, buffering agents, phase regulants, hydrotropes, polyacids, suds regulants, opacifiers, antioxidants, bactericides, dyes, perfumes, and brighteners described in the U.S. Pat. No. 4,285,841, Barrat et al, issued Aug. 25, 1981, incorporated herein by reference. Preferred neutralizing agents for use herein are organic bases, especially triethanolamine and monoethanol amine, which results in better detergency performance than inorganic bases such as sodium and potassium hydroxides.

The following non-limiting examples illustrate the compositions of the present invention. All percentages, parts and ratios used herein are by weight unless otherwise specified.

EXAMPLE I

Heavy duty liquid laundry detergent compositions are prepared by mixing the listed ingredients in the stated proportions:

| | Weight % | | | |
|---|---|---|---|---|
| Component | A | B | C | D |
| Sodium $C_{12-15}$ alkyl polyethoxylate (2.5) sulfate | 18.0 | 18.0 | 18.0 | 18.0 |
| Lauryl trimethyl ammonium chloride | — | — | 5.0 | 5.0 |
| $C_{12-13}$ alkyl polyethoxylate (9) | 2.0 | 2.0 | 2.0 | 2.0 |
| $C_{12}$ alkyl glucose amide | 5.0 | 5.0 | 5.0 | 5.0 |
| Citric acid | 3.0 | 3.0 | 3.0 | 3.0 |
| $C_{12-14}$ alkyl fatty acid | 2.0 | 7.0 | 2.0 | 5.0 |
| Ethanol | 3.7 | 3.7 | 3.7 | 3.7 |
| Propanediol | 8.0 | 8.0 | 8.0 | 8.0 |
| Monoethanolamine | 1.1 | 1.1 | 1.1 | 1.1 |
| Boric acid | 3.5 | 3.5 | 3.5 | 3.5 |
| Tetraethylenepentamine ethoxylated (15–18) | 1.2 | 1.2 | 1.2 | 1.2 |
| Sodium cumene sulfonate | 3.0 | 3.0 | 3.0 | 3.0 |

-continued

| Component | Weight % | | | |
|---|---|---|---|---|
| | A | B | C | D |
| Protease enzyme | 0.9 | 0.9 | 0.9 | 0.9 |
| Lipase enzyme | 0.1 | 0.1 | 0.1 | 0.1 |
| Cellulase enzyme | 0.08 | 0.08 | 0.08 | 0.08 |
| Sodium hydroxide | to pH 8.0 | | | |
| Water, perfume and minor ingredients | Balance to 100 | | | |

Four terry towel swatches (86% cotton/14% polyester blend) are washed in standard laundry loads in automatic clothes washers. Each load uses 0.48 cup (123 grams) of one of the above detergent compositions providing about 1900 ppm of the detergent composition to the wash water solution. The wash water is at 95° F. (35° C.) and the water hardness was 6 grains/gallon (3:1 $Ca^{++}$:$Mg^{++}$). After a standard wash cycle (wash, rinse and spin), the loads are tumbled dried in standard electric clothes dryers. For each load, four terry towel swatches (86% cotton/14% polyester blend) are used for grading softness; four loads are washed for each of the compositions, and the softness gradings are averaged. The swatches are graded manually by three expert graders. A grading scale of −4 to +4 panel score units (psu) is used, with +4 psu indicating much more softness advantage, 0 indicating no difference, and −4 psu indicating much less softness advantage. The results for each composition is averaged and Composition A is assigned a relative value of 0. The results were as follows:

| Softness | | |
|---|---|---|
| B vs A | C vs A | D vs A |
| about 0 psu | +0.8 psu | +1.3 psu |

These softness differences are statistically significant at 90% confidence interval.

Compositions C and D of the invention herein provide an improvement in fabric softness benefits over Composition A. Composition D also provides improved antistatic benefit over Composition A. Composition B, containing fatty acid but no cationic softening agent, provides essentially no increase in softness benefits over Composition A.

EXAMPLE II

Heavy duty liquid laundry detergent compositions are prepared by mixing the listed ingredients in the stated proportions:

| Component | Weight % | | |
|---|---|---|---|
| | E | F | G |
| Sodium $C_{12-15}$ alkyl polyethoxylate (2.5) sulfate | 18.0 | 18.0 | 18.0 |
| Lauryl trimethyl ammonium chloride | — | 5.0 | 5.0 |
| $C_{12-13}$ alkyl polyethoxylate (9) | 2.0 | 2.0 | 2.0 |
| $C_{12}$ alkyl glucose amide | 5.0 | 5.0 | 5.0 |
| Citric acid | 3.0 | 3.0 | 3.0 |
| $C_{12-14}$ alkyl fatty acid | 2.0 | 2.0 | 2.0 |
| Ethanol | 3.7 | 3.7 | 3.7 |
| Propanediol | 8.0 | 8.0 | 8.0 |
| Monoethanolamine | 1.1 | 1.1 | 1.1 |
| Boric acid | 3.5 | 3.5 | 3.5 |
| Tetraethylenepentamine ethoxylated (15–18) | 1.2 | 1.2 | 1.2 |
| Sodium cumene sulfonate | 3.0 | 3.0 | 3.0 |
| Protease enzyme | 0.9 | 0.9 | 0.9 |
| Lipase enzyme | 0.1 | 0.1 | 0.1 |
| Cellulase enzyme | 0.08 | 0.08 | — |
| Sodium hydroxide | to pH 8.0 | | |
| Water, perfume and minor ingredients | balance | | |

Using the three detergent compositions above, terry towel swatches are tested for softness in the same manner as for Example I. The results are as follows:

| Softness | |
|---|---|
| F vs E | G vs E |
| +0.8 psu | +0.9 psu |

These softness differences are statistically significant at 90% confidence interval.

The test shows that the Compositions F and G of the invention provide increased fabric softness benefits versus the prior art Composition E containing no cationic softening agent. Moreover, the softness benefit is not related to the presence of cellulase enzyme.

The Compositions F and G are clear, isotropic compositions, exhibit no precipitation of components after an extended period of time, and provide good anti-static benefits. In tests comparing the stain removal performance of Composition E versus compositions similar to Composition F (compositions of the present invention), the compositions are judged to be on average equal for the removal of ten different types of stains. In some greasy / oily stains (such as make-up and dirty motor oil stains), the compositions of the invention are judged to be better than the reference Composition E.

EXAMPLE III

Heavy duty liquid laundry detergent compositions are prepared by mixing the listed ingredients in the stated proportions:

| Component | Weight % | | |
|---|---|---|---|
| | H | 1 | 2 |
| Lauryl trimethyl ammonium chloride | 5.0 | 5.0 | 5.0 |
| $C_{12}$ alkylbenzenesulfonic acid | — | 7.2 | 18.0 |
| Sodium $C_{12-15}$ alkyl polyethoxylate (2.5) sulfate | 18.0 | 10.8 | — |
| $C_{12-13}$ alkyl polyethoxylate (9) | 2.0 | 2.0 | 2.0 |
| Citric acid | 3.0 | 3.0 | 3.0 |
| $C_{12-14}$ alkyl fatty acid | 2.0 | 2.0 | 2.0 |
| Ethanol | 3.7 | 3.7 | 3.7 |
| Propanediol | 8.0 | 8.0 | 8.0 |
| Monoethanolamine | 1.1 | 1.1 | 1.1 |
| Boric acid | 3.5 | 3.5 | 3.5 |
| Tetraethylenepentamine ethoxylated (15–18) | 1.2 | 1.2 | 1.2 |
| Sodium cumene sulfonate | 3.0 | 3.0 | 3.0 |
| Protease enzyme | 0.9 | 0.9 | 0.9 |
| Lipase enzyme | 0.1 | 0.1 | 0.1 |
| Cellulase enzyme | 0.08 | 0.08 | 0.08 |
| Sodium hydroxide | to pH 8.0 | | |
| Water, perfume and minor ingredients | balance | | |
| Appearance of Composition after one day at room temperature | Clear Thin | Phase Split | White Viscous |

The Composition H of the present invention, containing lauryl alkyl trimethyl ammonium chloride and no alkylbenzenesulfonic acid, is clear and stable for several months upon storage at room temperature. The reference Compositions 1 and 2, containing alkylbenzenesulfonic acid, have undesirable physical properties (phase split or high viscosity) after only one day.

EXAMPLE IV

A heavy duty liquid laundry detergent composition similar to Composition H above containing 5% $C_{12-14}$ fatty acid, 4% $C_{12-13}$ alkyl polyethoxylate (9) nonionic surfactant is prepared in the same manner as in Example III. The composition is clear, isotropic and stable for several months upon storage at room temperature, and provides good cleaning and softening benefits.

What is claimed is:

1. A substantially clear, aqueous, isotropic heavy duty liquid laundry detergent composition comprising, by weight of the composition:

a) from about 10% to about 40% of an anionic surfactant component which comprises, by weight of the composition:

(i) from about 5% to 40% of alkyl polyethoxylate sulfates wherein the alkyl group contains from 10 to 22 carbon atoms and the polyethoxylate chain contains from 1 to 15 ethylene oxide moieties; and (ii) no more than about 5% of alkyl benzene sulfonates; and b) from about 1% to about 10% of quaternary ammonium fabric-softening agent having the formula

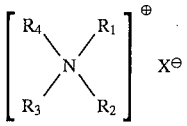

wherein $R_1$ and $R_2$ are individually selected from the group consisting of $C_1$–$C_4$ alkyl, $C_1$–$C_4$ hydroxy alkyl, benzyl, and —$(C_2H_4O)_xH$ where x has a value from 2 to 5; X is an anion; and (1) $R_3$ and $R_4$ are each a $C_8$–$C_{14}$ alkyl or (2) $R_3$ is a $C_8$–$C_{22}$ alkyl and $R_4$ is selected from the group consisting of $C_1$–$C_{10}$ alkyl, $C_1$–$C_{10}$ hydroxy alkyl, benzyl, and —$(C_2H_4O)_xH$ where x has a value from 2 to 5;

c) from about 1% to about 10% of a fatty acid containing from about 8 to about 20 carbon atoms;

provided that the anionic surfactant and quaternary ammonium fabric-softening agent are present in a weight ratio of at least about 3:1 wherein said composition is free from suspended crystal, precipitates or more than one liquid or liquid crystalline phase.

2. The composition of claim 1 comprising from about 15% to about 25% of the anionic surfactant component.

3. The composition of claim 1 wherein the anionic surfactant component comprises from about 7% to about 36% alkyl ethoxy sulfates.

4. The composition of claim 2 wherein the anionic surfactant component comprises from about 10% to about 25% alkyl ethoxy sulfates.

5. The composition of claim 1 wherein the anionic surfactant component comprises less than about 1% alkyl benzene sulfonates.

6. The composition of claim 1 wherein the anionic surfactant component comprises no alkyl benzene sulfonates.

7. The composition of claim 4 wherein the anionic surfactant component comprises no alkyl benzene sulfonates.

8. The composition of claim 1 comprising from about 3% to about 5% of the quaternary ammonium fabric-softening agent.

9. The composition of claim 3 comprising from about 3% to about 5% of the quaternary ammonium fabric-softening agent.

10. The composition of claim 6 comprising from about 3% to about 5% of the quaternary ammonium fabric-softening agent.

11. The composition of claim 7 comprising from about 3% to about 5% of the quaternary ammonium fabric-softening agent.

12. The composition of claim 1 wherein the quaternary ammonium fabric-softening agent is selected from the group consisting of lauryl trimethyl ammonium chloride, myristyl trimethyl ammonium chloride, coconut trimethyl ammonium chloride, coconut trimethyl ammonium methylsulfate, di- $C_{12}$–$C_{14}$ alkyl dimethyl ammonium chloride, and mixtures thereof.

13. The composition of claim 7 wherein the quaternary ammonium fabric-softening agent is selected from the group consisting of lauryl trimethyl ammonium chloride, myristyl trimethyl ammonium chloride, coconut trimethyl ammonium chloride, coconut trimethyl ammonium methylsulfate, di- $C_{12}$–$C_{14}$ alkyl dimethyl ammonium chloride, and mixtures thereof.

14. The composition of claim 1 comprising from about 3% to about 5% of lauryl trimethyl ammonium chloride.

15. The composition of claim 7 comprising from about 3% to about 5% of lauryl trimethyl ammonium chloride.

16. The composition of claim 1 wherein the weight ratio of anionic surfactant component to quaternary ammonium fabric-softening agent is from about 3:1 to about 20:1.

17. The composition of claim 15 wherein the weight ratio of anionic surfactant component to quaternary ammonium fabric-softening agent is from about 3:1 to about 20:1.

18. The composition of claim 1 comprising from about 3% to about 5% of fatty acid.

19. The composition of claim 7 comprising from about 3% to about 5% of fatty acid.

20. The composition of claim 15 comprising from about 3% to about 5% of fatty acid.

21. The composition of claim 1 wherein the fatty acid is selected from the group consisting of saturated $C_{12}$ fatty acid, saturated $C_{12}$–$C_{14}$ fatty acids, and saturated or unsaturated $C_{12}$ to $C_{18}$ fatty acids, and mixtures thereof.

22. The composition of claim 15 wherein the fatty acid is selected from the group consisting of saturated $C_{12}$ fatty acid, saturated $C_{12}$–$C_{14}$ fatty acids, and saturated or unsaturated $C_{12}$ to $C_{18}$ fatty acids, and mixtures thereof.

23. The composition of claim 20 wherein the fatty acid is selected from the group consisting of saturated $C_{12}$ fatty acid, saturated $C_{12}$–$C_{14}$ fatty acids, and saturated or unsaturated $C_{12}$ to $C_{18}$ fatty acids, and mixtures thereof.

24. The composition of claim 23 wherein the weight ratio of quaternary ammonium softening agent to fatty acid is preferably from about 1:1.5 to about 1.5:1.

25. The composition of claim 1 further comprising from about 1% to about 20% of an ethoxylated nonionic surfactant.

26. The composition of claim 25 wherein said ethoxylated nonionic surfactant is an ethoxylated alcohol surfactant.

27. The composition of claim 1 further comprising from about 1% to about 20% of a detergent builder material.

28. The composition of claim 27 wherein the builder material is citric acid present at from about 1% to about 10%.

29. The composition of claim 1 further comprising an enzyme selected from the group consisting of proteases, amylases, lipases, cellulases and mixtures thereof at a level sufficient to provide from about 0.01 mg to about 3 mg of active enzyme per gram of the composition.

30. The composition of claim 28 further comprising an enzyme selected from the group consisting of proteases, amylases, lipases, cellulases and mixtures thereof at a level sufficient to provide from about 0.01 mg to about 3 mg of active enzyme per gram of the composition.

* * * * *